United States Patent [19]

Porta et al.

[11] 4,214,184

[45] Jul. 22, 1980

[54] GETTER COMPRISING U-SHAPED, PARALLEL, LINEAR CHANNELS CONTAINING GETTER MATERIAL

[75] Inventors: Paolo D. Porta; Elio Rabusin, both of Milan, Italy

[73] Assignee: S.A.E.S. Getters S.p.A., Milan, Italy

[21] Appl. No.: 916,213

[22] Filed: Jun. 16, 1978

Related U.S. Application Data

[63] Continuation of Ser. No. 774,426, Mar. 4, 1977, Pat. No. 4,134,041.

[30] Foreign Application Priority Data

May 12, 1976 [IT] Italy ..... 23184 A/76

[51] Int. Cl.[2] ..... H01J 29/84; H01J 31/00

[52] U.S. Cl. ..... 313/481

[58] Field of Search ..... 313/174, 178, 181, 481, 313/774, 226, 176

[56] References Cited

U.S. PATENT DOCUMENTS

| | | | |
|---|---|---|---|
| 3,719,433 | 3/1973 | Rabusin | 313/181 X |
| 3,816,788 | 6/1974 | Reash | 313/174 |
| 4,134,041 | 1/1979 | Porta et al. | 313/481 |

FOREIGN PATENT DOCUMENTS

| | | | |
|---|---|---|---|
| 799291 | 8/1958 | United Kingdom | 313/481 |
| 1226728 | 3/1971 | United Kingdom | 313/481 |

*Primary Examiner*—Robert Segal

*Attorney, Agent, or Firm*—Quaintance, Murphy & Richardson

[57] ABSTRACT

A color television picture tube comprising a glass cone portion, a glass window portion and a metal screen cone. The metal screening cone is located within the volume defined by the glass cone portion and the glass window portion. At least a major portion of the metal screening cone is distanced away from the glass cone portion. An evaporable getter device comprising two parallel linear channel holders having U-shaped cross-sections, each containing a source of evaporable getter material is placed between the metal screening cone and the glass cone portion. Evaporable getter device is mounted on the metal screening cone by means of support legs. Getter material vapors from the getter device evaporate in a direction substantially parallel to a line formed by the nearest intersection of the glass cone portion and the glass window portion.

3 Claims, 7 Drawing Figures

GETTER COMPRISING U-SHAPED, PARALLEL, LINEAR CHANNELS CONTAINING GETTER MATERIAL

This application is filled under the provisions of 37 CFR 1.60 based on co-pending Application No. 774,426 filed on Mar. 4, 1977, now U.S. Pat. No. 4,134,041.

Colour television picture tubes are well known in the art. The envelope of a colour television picture tube generally comprises a comparatively narrow glass neck in which one or more electron guns is provided, a glass cone portion adjoining the glass neck and widening away from the neck portion, and a glass window portion which is secured to and closes the end of the cone remote from the neck. The neck and cone generally have a transitional dome portion which curves away from the axis of the tube. The cone and window portions are generally sealed together at high temperatures, which may be more than about 400° C., by means of a solder glass, enamel, or chemical binder. This sealing process generally takes place in air, during which time water vapour and other gases may be released from the glass parts.

During this sealing process there has already been placed within the volume defined by the glass cone portion and the glass window portion, a frame supporting a shadow mask and a ferro-magnetic screening cone.

After completion of the sealing process it is known to place a getter device in the neck portion of the tube. Getter devices usually comprise a getter holder containing an evaporable getter material which can be evaporated and which consists of a powder mixture of a barium aluminium alloy with a nickel or nickel alloy compressed into the getter holder. On subsequent heating of the getter device by means of high-frequency heating, a coating of getter material is caused to deposit on internal surfaces of the picture tube.

However this coating of getter material is generally unsatisfactory because the coating generally extends over at least the dome portion of the envelope and the shadow mask. It is often desired to provide a resistance layer on part of the inner wall of the tube envelope, this layer being connected to the electron gun assembly and to a high voltage supply conductor. This resistance layer generally extends over at least a portion of the dome of the envelope and is provided to avoid damage to the electron gun assembly such as would result from high voltage breakdowns. When a getter holder is used in the neck portion of the picture tube the resistance layer can be at least partially short circuited by the getter metal being deposited thereon.

Due to the bombardment of the shadow mask, which is usually fabricated from iron, by the electron beam there is a production of X-rays. When the shadow mask is coated with a film of barium, the most preferred getter material, this film is bombarded by the electron beam and the X-ray intensity is increased due to the higher atomic number of barium compared to that of iron.

A present trend in the use of kinescopes is to operate the tube at a higher anode voltage, that is the electrons are made to strike the phosphors with a higher energy than that commonly used previously. This increase in energy serves to increase picture definition, that is, the sharpness of the image. A further effect is to increase the brightness of the television picture and allow the image to be viewed with higher ambient light conditions, such that the image can even be conveniently viewed in normal daylight conditions.

The tendency to use higher anode voltages is especially prevalent in the case of colour kinescopes where the present anode voltage is about 25 kV and it is desired to use voltages of 30 kV and more.

An inconvenience resulting from the use of higher electron energies is that when the electrons impinge upon a target there is a production of even more intense X-rays. As the electron accelerating voltage becomes higher the X-rays are produced, when the electrons strike a target material, with a lower minimum wavelength. These "harder" X-rays, ie those X-rays of shorter wavelength are more penetrating and may thus pass into the air surrounding the television receiving apparatus wherein the kinescope is located.

Such X-rays can also cause undesirable darkening or browning of the kinescope tube glass.

It is well known that undue exposure to X-radiation is harmful to human beings and other life forms, to such an extent that Government or other regulations exist in most countries which specify the maximum levels of X-radiation that may be emitted from given devices.

Attempts to reduce browning of the tube glass and excessive X-ray emission into the surrounding atmosphere have been made by changing the chemical composition of the glass or by adding materials which easily absorb X-rays. One such change is by the addition of a lead compound to the glass mixture as lead is a well known absorber of X-radiation. Nevertheless these attempts have not been completely successful.

Other attempts to reduce the level of X-radiation have been made by substituting at least some of the barium getter material with strontium and/or calcium as these materials have a lower atomic number than that of barium. However calcium and strontium do not have a sufficient gas sorption speed or capacity.

Furthermore the getter material deposits in an uneven manner on the shadow mask which results in an uneven temperature rise of the mask on electron absorption. This causes misalignment of the shadow mask with respect to the phosphor zones and results in poor colour images.

Another defect of uneven getter material deposition on the shadow mask is that the material which passes through the holes in the mask is also deposited unevenly upon the phosphors. As a part of the energy of the electron beam is absorbed by the barium this can result in uneven excitation of the phosphors resulting in dark spots on certain areas of the screen.

It is also known to position the getter on the cone surface of the picture tube in the so called "antenna" position by securing the getter device to the gun assembly by means of a long resiliant metal strip. While a very effective getter device can be obtained in this way the problems concerning the use of a resistance layer remain, as well as the X-radiation and dark spot problems. In colour television picture tubes, where the angular positioning of the electron gun assembly is particularly critical, the antenna spring tension may cause misalignment of the gun assembly from its intended angular position.

U.K. Pat. No. 1,226,728 proposes the positioning of the getter device in a colour picture tube such that it is secured to the cone portion, the window portion or to a member (such as the screening cone) which is secured to the cone portion. However in order to ensure suitable gettering properties getter material is still caused to be deposited upon the shadow mask still resulting in one or more of the above mentioned problems.

It is therefore an object of the present invention to provide an improved colour television picture tube which is free of one or more of the disadvantages of prior art colour television picture tubes.

The invention provides a colour televison picture tube comprising a glass cone portion, a glass window portion and a metal screening cone said metal screening cone being located within the volume defined by said glass cone portion and said glass window portion, at least a major part of the metal screening cone being distanced away from the glass cone portion, an evaporable getter device between the metal screening cone and the glass cone portion said evaporable getter device comprising at least one source of getter material adapted to evaporate said getter material in a direction substantially parallel to the surfaces of the glass window portion, the glass cone portion and the metal screening cone.

The getter device may be attached by any suitable means between the metal screening cone and the glass cone portion but is preferably attached to the metal screening cone in such a way that it is distanced therefrom. The getter device may also be treated according to the process described in Italian Patent Application No. 30240 A/75 to protect it from damage by water vapour or by the heating process used to seal the glass window portion to the glass cone portion.

By causing the getter device to evaporate its getter material in a direction substantially parallel to the surface of the glass window portion, the glass cone portion and the metal screening cone it is found that in a colour television picture tube with a resistance layer on the dome portion there is deposited such a low amount of getter material in the dome portion that there is no danger of short circuiting. Furthermore such a low amount of getter material is deposited upon the shadow mask and phosphors that substantially all the X-radiation produced on operating the picture tube is that due to the iron shadow mask itself, which level of X-radiation is considered acceptable. Also the low amount of getter material deposited on the mask ensures that there is no uneven heat ption or radiation, with subsequent distortion of the mask, so that misalignment of the mask is maintained at a minimum. Again this low amount of getter material ensures that there are no dark areas visible on the screen when the picture tube is operated.

In order that the invention may be readily carried into effect, embodyments thereof will now be described with reference to the accompanying drawings wherein, FIG. 1 is a partially cut-away representation of a colour television picture tube of the present invention.

Figure 1:
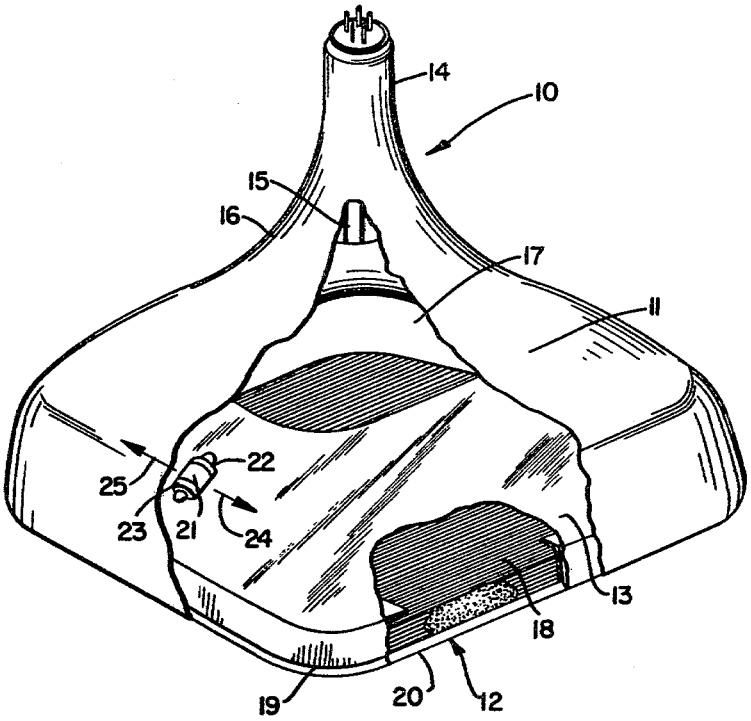

Referring to FIG. 1 there is shown a colour television picture tube 10 comprising a glass cone portion 11, a glass window portion 12 and a metal screening cone 13. A neck portion 14 containing an electron gun structure 15 is joined to the glass cone portion 11 by means of dome portion 16. Metal screening cone 13 is located within volume 17 defined by glass cone portion 11 and glass window portion 12. Picture tube 10 includes a shadow mask 18 attached to a rigid support frame 19 to which is also attached screening cone 13. An aluminium covered phosphor screen 20 capable of luminescing in three colours is situated on the internal surface of window portion 12.

Rigid support frame 19 is held within the picture tube by means not shown. Screening cone 13 is distanced away from glass cone portion 11. An evaporable getter device 21 is attached to metal screening cone 13 and between the metal screening cone 13 and the glass cone portion 11. Getter device 21 comprises a first source of barium 22 and a second source of barium 23.

First source of barium 22 and second source of barium 23 are oriented in such a way as to evaporate barium along directions show by arrows 24 and 25 respectively which are substantially parallel to the surface of the glass window portion 12, the glass cone portion 11 and the screening cone 13.

Figure 2:
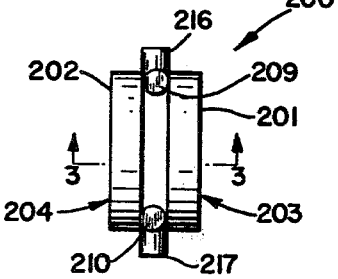
FIG. 2 is a plan view of a getter device suitable for use in the present invention.
Figure 3:
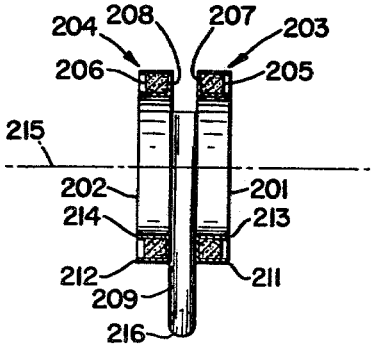
FIG. 3 is a cross-sectional view taken along line 3—3' of FIG. 2.

FIGS. 2 and 3 show a getter device 200 suitable for use in a colour television picture tube of the present invention. Getter device 200 comprises a first source 201 of getter material vapours and a second source 202 of getter material vapours in the form of U-shaped channel ring holders 203, 204 respectively. Ring holders 203, 204 respectively contain evaporable getter material 205, 206. The bases 207, 208 of the ring channels face each other and are both attached coaxially to two wire supports 209,210 to make a single getter device 200. The height of the outerwalls 211, 212 and the inner walls 213, 214 of sources 201, 202 may be much greater than the height of the getter materials contained therein to provide a more directional evaporation of the getter material vapours along the axis 215 of the sources 201, 202. Wire supports 209, 210 have one end bent to form attachment zones 216, 217 for welding getter device 200 to metal screening cone 13 as shown in FIG. 1.

Figure 4:
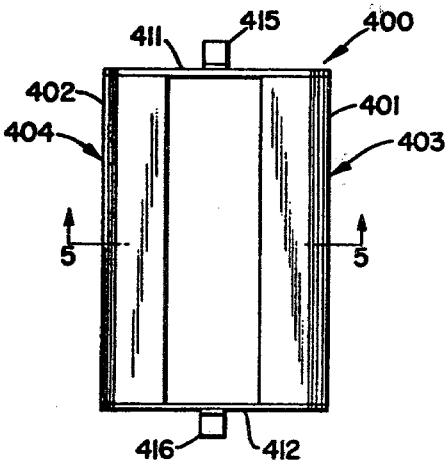
FIG. 4 is a plan view of another getter device suitable for use in the present invention.
Figure 5:
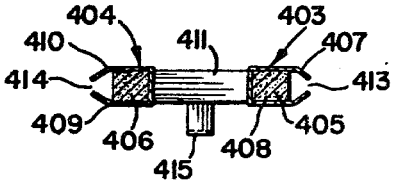
FIG. 5 is a cross-sectional view taken along line 5—5' of FIG. 4.

FIGS. 4 and 5 show another getter device 400 suitable for use in colour television picture tubes of the present invention. Getter device 400 comprises a first source 401 of getter material vapours and a second source 402 of getter material vapours in the form of U-shaped channel linear holders 403, 404 respectively. Evaporable getter material 405, 406 is placed within each of the channels. Side walls 407, 408, 409, 410 are inwardly bent at their extremities to partially close the getter material vapour outlet of linear holders 403, 404 to give greater directionality to the getter metal vapours on evaporation from getter device 400. Metal connecting strips 411, 412 are welded to the ends of each of the sources to form a closed loop such that the openings 413, 414 are facing horizontally outwards in the plane of the closed loop which can be heated by high frequency heating. Support legs 415, 416 are also attached to metal strips 411, 412 to be used in mounting getter device 400 on metal screening cone 13 as shown in FIG. 1.

Although closed loop sources have been described in UK Patent No. 799,291 it will be appreciated that those devices described would not be suitable for use in the present invention as they were mounted in the neck of the television tube, furthermore they evaporate getter material vapours in a direction perpendicular to their plane and not parallel to their plane, further they are able to evaporate only small quantities of barium.

Figure 6:
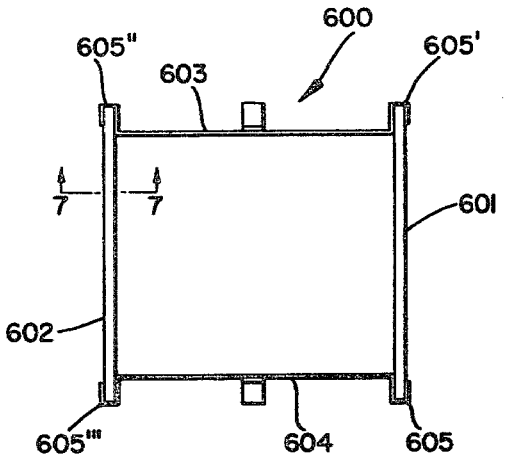
FIG. 6 is a plan view of a further getter device suitable for use in the present invention.
Figure 7:
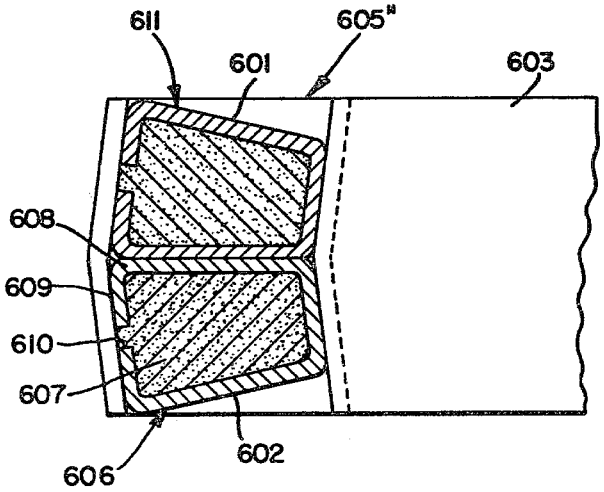
FIG. 7 is a cross-sectional view taken along line 7—7' of FIG. 6.

FIGS. 6 and 7 show a further getter device 600 suitable for use in colour television picture tubes of the present invention. Getter device 600 comprises a first multiple source 601 of getter material vapours and a second multiple source 602 of getter material vapours. Multiple sources 601, 602 are joined by metal strips 603, 604 to form a closed loop which can be heated by high frequency heating. The ends of metal strips are formed into L-shaped closure elements 605, 605', 605'', 605''' to firmly hold multiple sources 601, 602 and prevent escape of getter metal vapurs or particles in unwanted directions. Multiple source 602 comprises a first element 606 containing evaporable getter material 607 within a trapezoidal cross-section container 608 whose outwardly facing wall 609 contains an exit slit 610 for the issuance of getter material vapours outwardly in the plane defined by the closed loop. A second element 611, identical to first element 606 is placed in abutting relationship with first element 606. Multiple source 601 is identical to multiple source 602 except that the exit slits of the containers face in a direction substantially 180° from the exit slits of multiple source 602.

It will be realized that several getter devices of the present invention may be placed in a single picture tube at different positions around the screening cone. Furthermore a single getter device having two getter material vapour sources may be placed at a corner of the tube such that they evaporate in a direction perpendicular to each other while still ensuring that each source evaporates said getter material vapours in a direction substantially parallel to the surface of the glass window portion the glass cone portion and the metal screening cone.

Although the invention has been described in considerable detail with reference to certain preferred embodyments designed to teach those skilled in the art how best to practice the invention it well be realized that other modifications may be employed without departing from the spirit and scope of the appended claims.

What is claimed is:

1. A color television picture tube comprising:

(I)

(A) a glass cone portion;

(B) a glass window portion;

(C) a metal screening cone located within the volume defined by the glass cone portion and the glass screen portion, at least a major part of the metal screening cone being distanced away from the glass cone portion; and (D) an evaporable getter device comprising two parallel linear channel holders having U-shaped cross-sections, each containing a source of evaporable getter material, each linear holder having an inner facing wall, two side walls and two end walls, the outer portion forming the opening of the cross-sectional U-shape, linear holders being joined to each other by metal strips connecting the ends of each of the linear holders to form a closed loop substantially lying in a single plane, such that the openings of the linear holders are facing substantially outwards and away from each other, said metal connecting strips further comprising support legs for mounting the getter device;

(II) with the provisos that (a) the evaporable getter device is mounted on the metal screening cone by means of the support legs at a point between the metal screening cone and the glass cone portion, and (b) the evaporable getter device is oriented in such a way as to evaporate the getter material in a direction substantially parallel to a line formed by the nearest intersection of the glass cone portion and the glass window portion.

2. The color television picture tube of claim 1 wherein the side walls of each linear holder are inwardly bent at their extremities to close partially the getter material vapor openings of the linear holders.

3. The color television picture tube of claim 1 wherein each linear holder itself comprises a multiple source of getter material vapors comprising two substantially identical parallel linear channels each having a trapezoidal-shaped cross section, abutting each other along one side wall, the inner facing walls being the top of the trapezoid and the opening comprising a slit running the length of the channel in the outwardly facing side, said side being the base of the trapezoid.

* * * * *